US006936349B2

(12) United States Patent
Naganuma et al.

(10) Patent No.: US 6,936,349 B2
(45) Date of Patent: Aug. 30, 2005

(54) METHOD OF COLORING MAGNESIUM MATERIAL, AND HOUSING MADE OF COLORED MAGNESIUM MATERIAL

(75) Inventors: Yasuo Naganuma, Kawasaki (JP); Masami Tsutsumi, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 340 days.

(21) Appl. No.: 10/230,979

(22) Filed: Aug. 30, 2002

(65) Prior Publication Data

US 2003/0052012 A1 Mar. 20, 2003

(30) Foreign Application Priority Data

Sep. 17, 2001 (JP) ..... 2001-281876
Feb. 15, 2002 (JP) ..... 2002-037694

(51) Int. Cl.[7] ..... C25D 11/30

(52) U.S. Cl. ..... 428/469; 205/50; 205/109; 205/199; 205/223; 205/229; 205/321; 205/917

(58) Field of Search ..... 205/50, 109, 199, 205/223, 229, 321, 917; 428/469

(56) References Cited

U.S. PATENT DOCUMENTS 4,551,211 A * 11/1985 Kobayashi et al. ..... 205/199
4,806,390 A * 2/1989 Hawker et al. ..... 427/156
6,083,309 A * 7/2000 Tomlinson ..... 106/14.21
6,335,099 B1 1/2002 Higuchi et al.

FOREIGN PATENT DOCUMENTS

| | | |
|---|---|---|
| EP | 0 936 288 A2 | 8/1999 |
| JP | 11-236698 | 8/1999 |
| JP | 11-256394 | 9/1999 |
| JP | 2001-518983 | 10/2001 |
| WO | WO 98/42895 | 10/1998 |

* cited by examiner

*Primary Examiner*—Roy King
*Assistant Examiner*—William T. Leader
(74) *Attorney, Agent, or Firm*—Armstrong, Kratz, Quintos, Hanson & Brooks, LLP

(57) ABSTRACT

A housing made of a magnesium material is colored by a non-painting process. In this process, an anode oxide film is grown on the surface of the housing by subjecting the housing to anodization. The anode oxide film is colored without a paint being applied to the surface of the film.

8 Claims, 7 Drawing Sheets

FIG.4
| Activation \ Dye | Sanodal Orange | Sanodal Blue |
|---|---|---|
| Complexing Agent 0.55M Immersion 10 min | Example 3 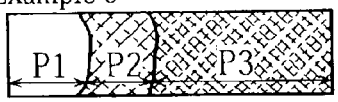  | Example 8 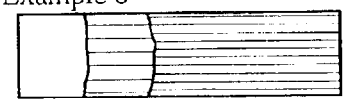 |
| Complexing Agent 0.05M Immersion 30 min | Example 4 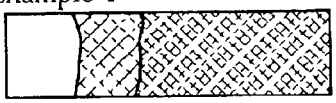 | Example 9 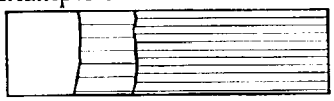 |
| Complexing Agent 0.1M Immersion 10 min | Example 5 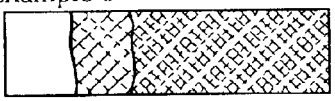 | Example 10 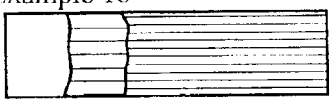 |
| Complexing Agent 0.2M Immersion 10 min | Example 6 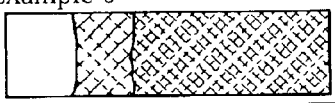 | Example 11 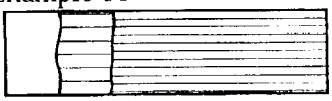 |
| Complexing Agent 0.2M Immersion 30 min | Example 7 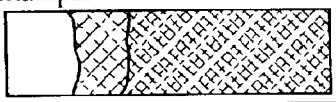 | Example 12 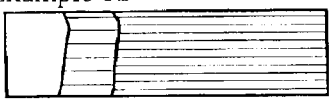 |
| No Treatment | Comparative Exmaple 1 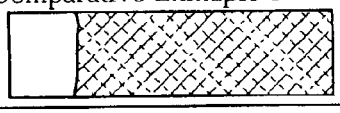 | Comparative Example 2 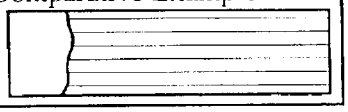 |

FIG.5
| Activation \ Dye | Sanodal Blue |
|---|---|
| Immersion 10 min<br>Solution 25℃ | Example13<br> 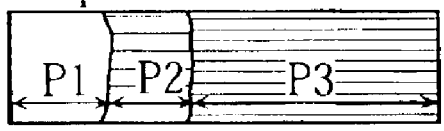 |
| Immersion 30 min<br>Solution 25℃ | Example14<br> 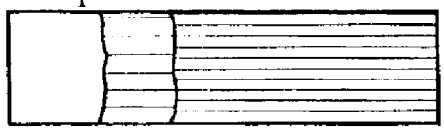 |
| Immersion 10 min<br>Solution 60℃ | Example15<br> 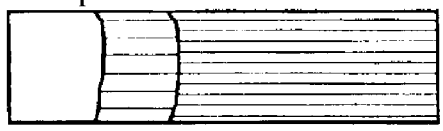 |
| Immersion 30 min<br>Solution 60℃ | Example16<br> 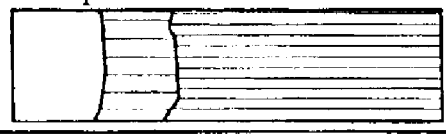 |

FIG.6

| Dye \ Coupling Agent | KBM-903 | A-1120 | KBM-803 | No Treatment |
|---|---|---|---|---|
| Sanodal Orange (Azo Dye) | Example 17 | Example 22 | Comparative Example 3 | Comparative Example 8 |
| Sanodal Blue (Anthoraquinone Dye) | Example 18 | Example 23 | Comparative Example 4 | Comparative Example 9 |
| Sanodal Yellow (Methine Dye) | Example 19 | Example 24 | Comparative Example 5 | Comparative Example 10 |
| Sanodal Green (Azo Dye) | Example 20 | Example 25 | Comparative Example 6 | Comparative Example 11 |
| Sanodal Turquoise (Phthalocyanine Dye) | Example 21 | Example 26 | Comparative Example 7 | Comparative Example 12 |

METHOD OF COLORING MAGNESIUM MATERIAL, AND HOUSING MADE OF COLORED MAGNESIUM MATERIAL

BACKGROUND OF THE INVENTION

1. Field of the Invention

The present invention relates to a method of coloring a magnesium material to be used for making the housing of a portable device such as a notebook computer. The present invention also relates to a housing made of such a colored magnesium material. The "magnesium material" in this specification refers to both pure metal magnesium and a magnesium alloy.

2. Description of the Related Art

Recently, the housings of mobile electronic devices such as notebook computers and cellular phones are often made of a magnesium material, so that the electronic products are compact and light. The housing made of a magnesium material is also advantageous to causing the heat generated by the inside components (e.g. the CPU, MPU, etc.) to efficiently dissipate. As known, a magnesium material is an easily oxidizable metal. Thus, to be used for making a housing, the magnesium material is subjected to surface treatment to be resistible against corrosion.

One of the known anticorrosive techniques is chemical conversion treatment, whereby a magnesium material is immersed in chemicals to develop a coating film on the material surface. The conversion treatment utilizes chemical reaction that occurs voluntarily. Thus, it is difficult to control the process and hence the thickness of the coating film. Another problem is that the resultant coating film often fails to grow to be thick enough to exhibit appropriate resistance against corrosion.

Anodic treatment, or anodizing, is preferable to the above conversion treatment in forming a thicker coating film. JP-A-11(1999)-256394, for example, discloses an anodizing technique for an aluminum material, which can be applied for anodizing a magnesium material. By the conventional anodic treatment, however, the oxide film formed on the magnesium material is rather dark or sober. Unfavorably, this may deteriorate the appearance of the finished product.

To decorate the magnesium material of the above-described kind, an organic paint, which is less influenced by the dark color of the oxide film, needs to be applied to the oxide film. The organic paint, however, generates toxic gas when it is burnt. To avoid this, the organic paint film needs to be removed with a solvent or by wet blasting in the recycling process. However, the removing of the paint film deteriorates the working conditions and increases the number of the steps to be performed. Further, the organic paint film tends to peel off the material surface due to the deterioration of the film quality, which is not desirable for good appearance of the product.

SUMMARY OF THE INVENTION

The present invention has been proposed under the circumstances described above. It is, therefore, an object of the present invention to provide a coloring method for a magnesium material, whereby no organic paint is applied to the oxide film formed on the magnesium material, and still the coloring for the magnesium material can be properly performed.

Another object of the present invention is to provide a housing made of a magnesium material colored by such a method.

According to a first aspect of the present invention, there is provided a method of coloring an object made of a magnesium material which is selected from the group consisting of pure metal magnesium and a magnesium alloy. In the method, an anode oxide film is grown on a surface of the object by subjecting the object to anodization. Advantageously, the anode oxide film is colored by a non-painting process.

Preferably, the anodization utilizes an electrolyte containing a pigment, and the color of the anode oxide film is provided by allowing the pigment to be taken into the anode oxide film growing on the surface of the object.

In this way, the oxide film is colored as it is growing on the object. This is advantageous to improving the manufacturing efficiency. Also, the selection of the color for the object is readily made by controlling the kind and amount of the pigments to be suspended in the electrolyte solution.

Preferably, the pigment may be an inorganic pigment or lake pigment provided by dyeing an extender pigment. The pigment to be sued may have an average particle size of 5 nm–50 $\mu$m, and more preferably, 5–500 nm. The smaller the particle size is, the more minutely the anode oxide film can be colored.

The method of the present invention may further include the steps of: activating a surface of the anode oxide film; and dyeing the activated surface with a dye to provide the color of the anode oxide film.

Preferably, the surface of the anode oxide film may be roughened in the activating step by exposure to one selected from the group consisting of a complexing agent and pyrophosphate. Alternatively, the surface of the anode oxide film may be chemically modified in the activating step by exposure to a silane coupling agent having amino group.

Preferably, the electrolyte used in the above-mentioned anodization is selected from the group consisting of sodium aluminate, sodium metasilicate, and sodium silicate.

Preferably, the method of the present invention may further include the step of covering the colored anode oxide film with an inorganic coating material.

According to a second aspect of the present invention, there is provided a housing made of a magnesium material for a portable device. This housing maybe colored by the above-noted methods.

BRIEF DESCRIPTION OF THE DRAWINGS

FIG. 4 shows the state of dye for Examples 3–12 and Comparative Examples 1–2;

FIG. 5 shows the state of dye for Examples 13–16;

FIG. 6 shows the state of dye for Examples 17–26 and Comparative Examples 3–12.

DETAILED DESCRIPTION OF THE PREFERRED EMBODIMENTS

Figure 1:
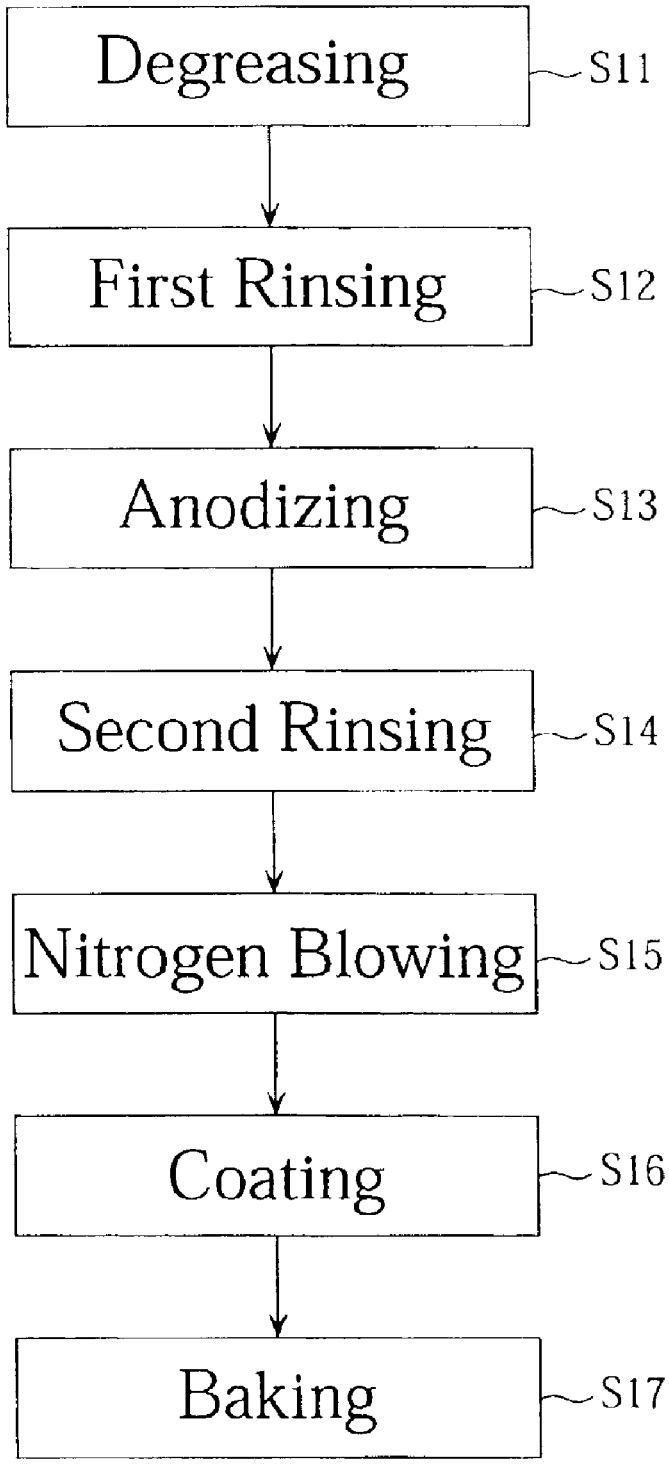
FIG. 1 is a flow chart of a coloring method according to a first embodiment of the present invention.

FIG. 1 is a flow chart illustrating how a coloring process according to a first embodiment of the present invention is carried out. As seen from the chart, the process includes a degreasing step S11, a first rinsing step S12, an anodizing step S13, a second rinsing step S14, a nitrogen blow step S15, a coating step S16 and a baking step S17.

Figure 7:
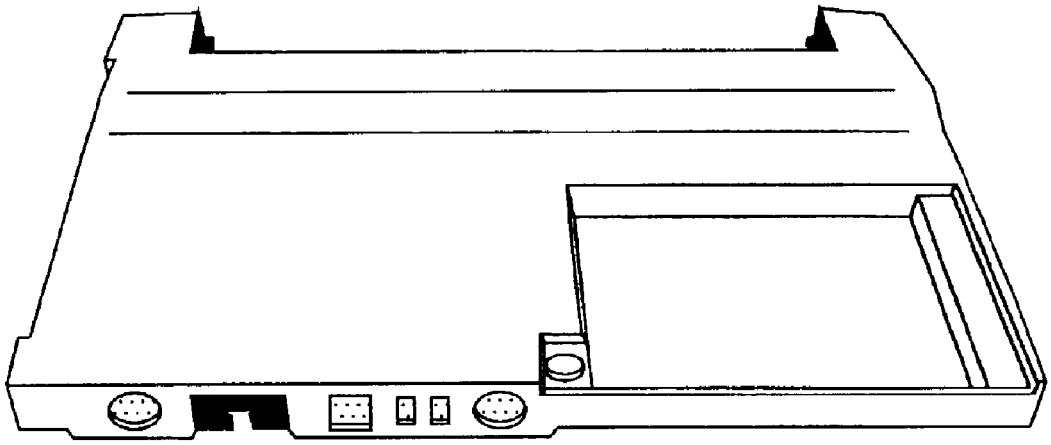
FIG. 7 shows a housing component made of a magnesium material.

In the embodiments below, a rectangular piece, or strip, of a magnesium material is depicted as the target object to be colored by the process of the present invention, since such a simple configuration is suitable for understanding the technical significance of the present invention. It should be noted, however, that the present invention is applicable not only to such metal strips but also to a more complicated product like the one shown in FIG. 7. The product of FIG. 7 is a liquid crystal display cover used as a component of the housing for a notebook computer. This cover can be formed from one of the magnesium materials mentioned below and colored by the process of the present invention.

Material strips used in the embodiments are made of a magnesium material including pure metal magnesium and magnesium alloys. Examples of the magnesium alloys are Mg—Al alloy, Mg—Al—Zn alloy, Mg—Al—Mn alloy, Mg—Zn—Zr alloy, Mg-rare earth element alloy or Mg—Zn-rare earth element alloy. More specifically, they may be AZ91D, AZ31, AZ61, AM60 or AM120.

In the degreasing step S11, a material strip is subjected to organic removal treatment. Specifically, the material strip is immersed into acetone and then alkaline solution. The alkaline solution may contain sodium carbonate, sodium hydroxide or potassium hydroxide. Another possible way of degreasing is to apply a surface active agent, e.g. sodium dodecylbenzenesulfonate, to the surfaces of the material strip.

Then, in the first rinsing step S12, the material strip is rinsed with running water to remove the remaining degreasing agent.

Then, in the step S13, the material strip is subjected to anodizing with the use of an electrolytic solution, or electrolyte. Generally the electrolyte may contain several reagents for oxide film formation and coloring pigments. Examples of the film-forming reagents are sodium aluminate, sodium metasilicate and sodium silicate, which are suitable for forming a white oxide film. Examples of the coloring pigments are an inorganic pigment such as pearl pigments, and an organic pigment such as lake pigments. A lake pigment is provided by dyeing an extender pigment such as aluminum hydroxide or titanium oxide. For the inorganic pigments, use may be made of iron red ($Fe_2O_3$), vermilion (HgS), cadmium red (CdS or CdSe), chrome yellow ($PdCrO_4$), ultramarine blue ($2Al_2Na_4Si_3O_{10}S_4$), cobalt blue ($CoO.nAl_2O_3$), cobalt violet ($Co_3(PO_4)_2$) or carbon black. The use of an inorganic pigment is preferable because a product made of a magnesium material colored with an inorganic pigment generates substantially no organic toxic gas-even when burned for recycling.

In the embodiment, the pigment has an average particle size of 5–500 nm. The above electrolyte is so prepared as to cause spark discharge in electrolysis.

Figure 2:
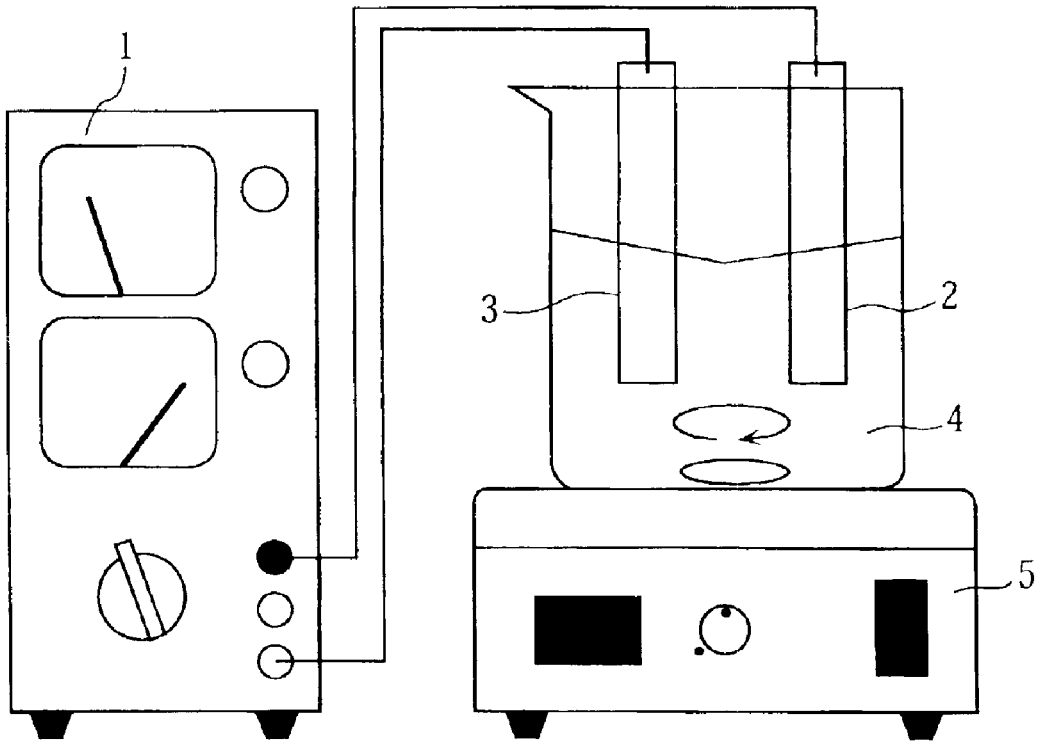
FIG. 2 is a schematic view illustrating an anodizing apparatus used for the present invention.

FIG. 2 schematically illustrates an anodizing apparatus used for the anodizing step S13. The apparatus includes a power supply 1 one terminal of which is electrically connected to the material strip 2 to be colored and the other terminal of which is electrically connected to a stainless electrode or carbon electrode 3. The material strip 2 and the electrode 3, serving as paired electrodes, are immersed in the above-described electrolyte 4. Then, an alternate current is applied across the paired electrodes. The current density may be in a range of 0.5–5A/dm$^2$. If the current density is below this range, no proper spark discharge will occur. If the current density is above this range, the surface of the resultant oxide film will be unduly rough. The temperature for the electrolyte is kept in a range of 15–60° C. If the temperature is lower than 15° C., the speed of oxide film formation will be unacceptably low. If the temperature is higher than 60° C., the oxide film surface will become unduly rough. To uniformly disperse the pigment in the electrolyte, the electrolyte is stirred by a magnetic stirrer 5. In the anodizing, spark discharge occurs in the surface of the material strip (the anode), and an anode oxide film builds up on the surface. At this time, the pigment dispersed in the electrolyte is taken into the growing oxide film. As a result, the resultant oxide layer, whose thickness may be in a range of 5–20 $\mu$m, is colored.

Then, in the second rinsing step S14, the material strip is rinsed with running water to remove the remaining electrolyte on the strip.

Then, in the nitrogen blow step S15, nitrogen gas is blown to the material strip to scatter or evaporate the water on the strip.

Then, in the coating step S16, a coating layer is formed over the anode oxide film on the material strip. Specifically, liquid coating material is applied onto the anode oxide film by a method of spin coating, dip coating, doctor blading, or roll coating. Examples of the coating material are a commercially available inorganic coating material or a metal oxide sol which is solidified by the sol-gel processing.

Then, in the baking step S17, the coating layer is hardened. Specifically, after the application of the coating material is over, the material strip is left at room temperature for about 30 minutes. Thereafter, the coated material strip is baked in an oven at 120° C. for about 30–60 minutes, so that the coating layer on the oxide film is hardened. Advantageously, the coating layer adds gloss to the colored anode oxide film, as well as protects the oxide film. When no such coating layer is desired, the coating step 16 and the baking step 17 are not performed.

According to the above-described method of coloring a magnesium material, an anode oxide film, which is inherently white, builds up on the surface of the magnesium material as taking in the dispersed pigment. In this way, the anode oxide film is colored as desired, and still the prior-art problems of deteriorating working conditions and increasing the number of process steps in the recycling procedure can be eliminated. Also, since the anode oxide film is colored by the pigment taken into the film, the coloration for the material strip is reliably maintained.

Figure 3:
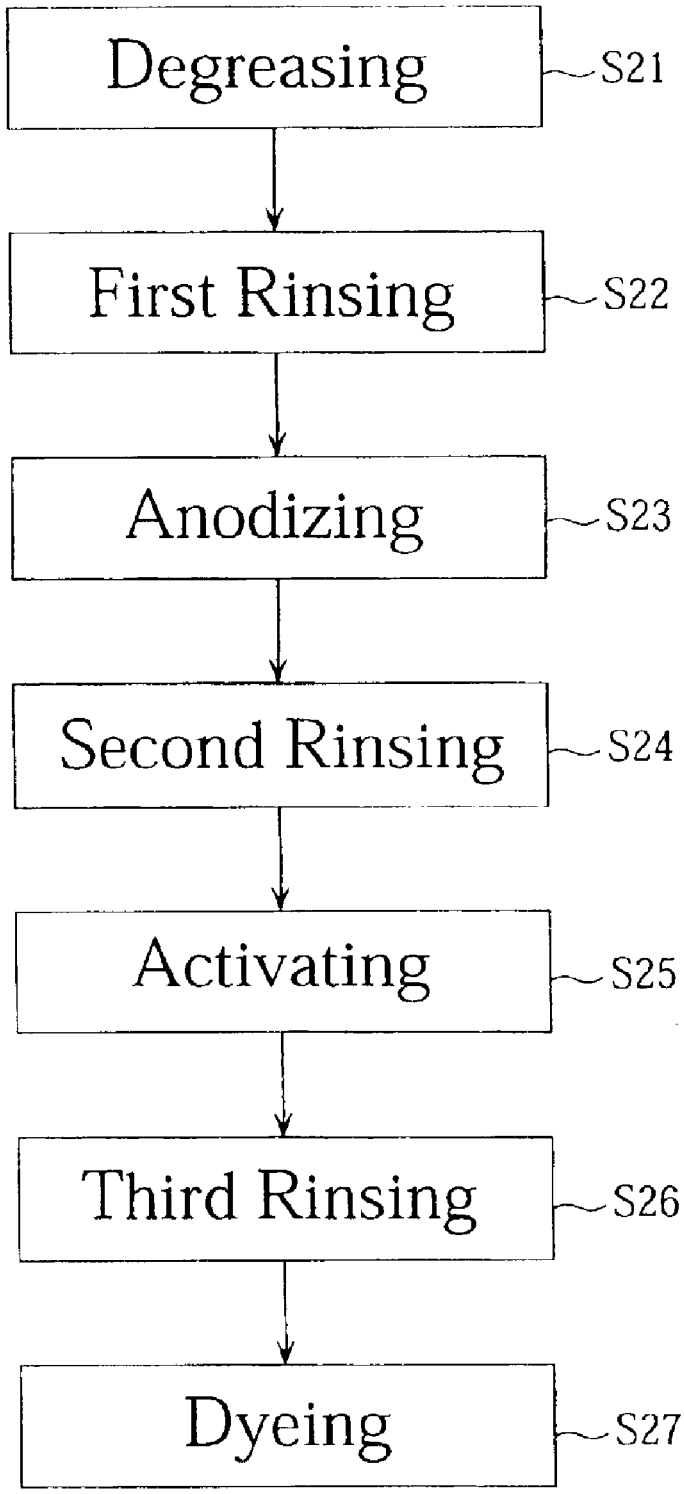
FIG. 3 is a flow chart of a coloring method according to a second embodiment of the present invention.

FIG. 3 is a flowchart showing a magnesium material coloring process according to a second embodiment of the present invention. The process of this embodiment includes a degreasing step S21, a first rinsing step S22, an anodizing step S23, a second rinsing step S24, an activating step S25, a third rinsing step S26 and a dyeing step S27.

In this second embodiment, a material strip made of a material strip is first subjected to the degreasing step S21 and then to the first rinsing step S22, as in the counterpart steps of the first embodiment, with the use of similar reagents.

Then, in the anodizing step 23, the material strip is subjected to anodic oxidation treatment. In performing the anodizing, use is made of an electrolyte containing several reagents for forming an oxide film. Examples of the reagents are sodium aluminate, sodium metasilicate and sodium silicate, which are suitable for forming a white oxide film. Containing these reagents, the electrolyte is so prepared as to cause spark discharge during the electrolysis. In this embodiment again, the anodizing apparatus shown in FIG. 2 is utilized. Specifically, the anode terminal of the apparatus is electrically connected to the material strip 2, while the cathode terminal is electrically connected to the electrode 3 made of stainless steel or carbon. With the material strip 2 and the electrode 3 immersed in the electrolyte 4, a direct current is applied across the paired electrodes, thereby performing constant-current electrolysis. The density of the applied current may be in a range of 1–8A/dm$^2$. The electrolyte is maintained at 15–60° C. and constantly stirred with a magnetic stirrer 5. In this arrangements, spark discharge occurs in the surface of the material strip, whereby an anode oxide film builds up on the surface of the strip. The resultant thickness of the anode oxide film may be 5–10 $\mu$m.

Then, in the second rinsing step S24, the material strip is rinsed with running water to remove the remaining electrolyte on the strip.

Then, in the activating step 25, the surface of the anode oxide film on the material strip is activated for enhancing its susceptibility or affinity to dye. The activation may be performed by immersing the material strip with the anode oxide film into an aqueous solution containing a complexing agent such as EDTA or pyrophosphate, so that the surface of the anode oxide film is roughened. As another activation method, the material strip provided with the anode oxide film may be immersed in an aqueous solution containing silane coupling agent to chemically modify the surface of the anode oxide film. The silane coupling agent may contain amino group.

Then, in the third rinsing step S26, the material strip is rinsed with running water to remove the remaining activating agent on the strip. Thereafter, the material strip is dried. To dispense with this drying step, 10–50% of alcohol, such as methanol, ethanol or isopropyl alcohol, may be added to the coupling agent if used in the step S25. In this case, care should be taken so that too much alcohol will not be added to the coupling agent. If the amount of the added alcohol is excessive, the material strip will dry too quickly and have mottled surfaces.

Then, in the dyeing step S27, the material strip formed with the white anode oxide film is dyed by immersing in a dye solution. Examples of the dye are azo dyes, anthraquinone dyes, indigoid dye, phthalocyanine dyes, sulfur dye, triphenylmethane dye, pyrazolone dye, stilbene dye, diphenylmethane dye, xanthene dye, alizarin dye, acridine dye, azine dyes, oxazine dyes thiazine dye, thiazole dye, methine dye, nitro dye and nitroso dye. The dye solution may be prepared by dissolving a dye in water at a concentration of 0.1–5.0 g/L. The pH level of the solution is adjusted to be 5–6 by adding buffer solution.

The dye solution is heated and kept at a temperature of 50–60° C. Then, the material strip formed with the anode oxide film is immersed in the dye solution for 10–30 minutes. Subsequently, the material strip is pulled out of the dye solution and rinsed with running water to remove the remaining dye solution. Thereafter, the material strip is subjected to nitrogen blow and dried in an oven. Preferably, the drying is performed at 120–150° C. for 30–60 minutes. By appropriately selecting the dye, the anode oxide film on the material strip is colored as desired.

In the second embodiment again, a coating layer maybe formed on the anode oxide film by performing a coating step and a subsequent baking step.

With the method of the second embodiment, the anode oxide film is dyed after its surface is activated. Since no paint layer is formed on the material strip by the second embodiment again, the conventional problem of the peeling of a paint layer is eliminated. Further, the deterioration of the working conditions and the increase in the number of the process steps in performing the recycling are also avoided.

The present invention will now be described through examples and comparative examples. Examples 1, 2 correspond to the first embodiment, whereas Examples 3–26 correspond to the second embodiment.

EXAMPLE 1

[Preparation of Electrolyte]

An electrolyte was prepared which contained 100 g/L of sodium aluminate (Supplier: KANTO KAGAKU) and 10% of pearl pigment (Tradename: Iriodin Blue WII, Supplier: Merck). The pH level of the electrolyte was 13.6.

[Coloring]

An AZ31 alloy plate (Supplier: Toyo Mark Co., Ltd., Size: 70 mm×20 mm×1.5 mm) as a material strip was prepared. The alloy plate was subjected to the degreasing step and the subsequent first rinsing step. Then, the alloy plate and a stainless (SUS-304) plate were immersed in the electrolyte contained in the apparatus shown in FIG. 2. AC electrolysis was performed for 10 minuets with a current density of 4A/dm$^2$. During the electrolysis, the electrolyte was kept at 30° C. and stirred with the magnetic stirrer at a rate of 400 rpm. After the material strip was pulled out of the electrolyte, it was subjected to the second rinsing with running water. Then, the material strip was dried in the nitrogen blow step. As a result, an anode oxide film, colored green by incorporating the pigment, was formed on the AZ31 alloy plate.

EXAMPLE 2

[Preparation of Electrolyte]

An electrolyte was prepared which contained 200 g/L of sodium metasilicate (Supplier: Wako Pure Chemical Industries, Ltd.) and 10% of pearl pigment (Tradename: Iriodin 153 WII, Supplier: Merck) and had a pH level of 13.

[Coloring]

An AZ31 alloy plate (Supplier: Toyo Mark Co., Ltd., Size: 70 mm×20 mm×1.5 mm) as a material strip was prepared. The alloy plate was subjected to the degreasing and the subsequent first rinsing steps. Then, with the AZ31 alloy plate and a stainless (SUS-304) plate immersed in the electrolyte, AC electrolysis was performed for 10 minuets at a current density of 4A/dm$^2$ using the apparatus of FIG. 2. During the electrolysis, the electrolyte was maintained at 30° C. Then, the material strip was pulled out of the electrolyte and was subjected to the second rinsing with running water. Then, the material strip was dried in the nitrogen blow step. Then, the material strip was immersed in inorganic coating heatless glass (Tradename: GS-600-1 type BC, Supplier: OHASHI CHEMICAL INDUSTRIES LTD.) and pulled out at a rate of 3 mm/sec. Thereafter, the material strip was left at room temperature for 30 minutes, and then dried in an oven at 120° C. for 60 minutes. As a result, the coating layer was baked and fixed to the anode oxide film, which was colored gold due to the pigment taken in.

EXAMPLES 3–12 AND COMPARATIVE EXAMPLES 1, 2

[Preparation of Electrolyte]

An aqueous solution was prepared which contained 2.9M of potassium hydroxide, 0.6M of pottasium fluoride, 0.1M of trisodium phosphate, 0.5M of sodium aluminate and 0.13M of sodium stannate. The pH level of the solution was 14. This solution was used for the anodizing of the material strip to be described below. (Precisely, 0.14M of diethylene glycol was added to the prepared solution just before the beginning of the anodizing.)

[Coloring]

Twelve AZ31 alloy plates (Supplier: Toyo Mark Co., Ltd. Size: 70 mm×20 mm×1.5 mm) as material strips were prepared for Examples 3–12 and Comparative Examples 1–2. First, the twelve material strips were subjected to degreasing. Then, the material strips were immersed in an aqueous solution which contained 30 g/L of sodium hydroxide and 30 g/L of potassium hydroxide and maintained at 80° C. for 30 minutes. Then, the material strips were rinsed with water in the first rinsing step. Then, each of the material strips was subjected to anodizing. Specifically, with each material strip and a stainless (SUS-304) plate immersed in the above-mentioned electrolyte contained in the apparatus of FIG. 2, constant-current electrolysis was performed for 15 minutes at a current density of 1A/dm$^2$. At this time, each material strip was immersed so that the regions P2, P3 shown in FIG. 4 were in the electrolyte, which was maintained at 25° C. As a result, an anode oxide film having a thickness of about 10 $\mu$m was formed on the material strip. Then, the material strip was pulled out of the electrolyte and was subjected to the second rinsing with running water. Subsequently, the material strip was dried by nitrogen blow.

Then, each material strip of Examples 3–12 was subjected to activation. The material strips of Comparative Examples 1–2, on the other hand, were not subjected to activation. For the activation, the material strips of Examples 3–12 were immersed in a surface activating solution containing EDTA-4Na (Supplier: DOJINDO LABORATORIES) as a complexing agent. During this, the activating solution was kept at about 25° C. Each material strip was immersed so that the region P3 shown in FIG. 4 was in the solution. The complexing agent concentration and the immersion time in each of the Examples were as follows. For Examples 3 and 8, the material strip was immersed in 0.05M complexing agent solution for 10 minutes. For Examples 4 and 9, the material strip was immersed in 0.05M complexing agent solution for 30 minutes. For Examples 5 and 10, the material strip was immersed in 0.1M complexing agent solution for 10 minutes. For Examples 6 and 11, the material strip was immersed in 0.2M complexing agent solution for 10 minutes. For Examples 7 and 12, the material strip was immersed in 0.2M complexing agent solution for 30 minutes. As noted above, the material strips of Comparative Examples 1 and 2 were not immersed in the surface activating solution.

Then, the activated material strips were rinsed with running water (the third rinsing step), and then dried. Thereafter, the material strips of Examples 3–12 and Comparative Examples 1–2 were dyed. Specifically, the material strips of Examples 3–7 and Comparative Example 1 were immersed in a dye solution for 10 minutes, where the dye solution was kept at 55° C. and contained 5 g/L of orange dye (Tradename: Sanodal Orange, Supplier: Clariant K. K.). The pH level of the dye solution was adjusted to be 5.5 by addition of ammonium acetate buffer solution. The material strips of Examples 8–12 and Comparative Example 2, on the other hand, were immersed in another dye solution for 10 minutes. This dye solution was kept at 55° C. and contained 3 g/L of blue dye (Tradename: Sanodal Blue, Supplier: Clariant K. K.) and its pH level was adjusted to be 5.5 by addition of ammonium acetate buffer solution. Each of the material strips was immersed so that the regions P2 and P3 shown in FIG. 4 were in the dyeing solution. Subsequently, each material strip was pulled out of the solution and rinsed with running water for at least 30 seconds. Thereafter, the material strip was subjected to nitrogen blow and then heated in an oven at a temperature of 130° C. for 30 minutes for drying.

[Results of Dyeing]

FIG. 4 schematically illustrates the state of the dye performed for the material strips of Examples 3–12 and Comparative Examples 1 and 2. In each strip, the reference sign P1 indicates a bare metal region, the reference sign P2 indicates a region where the oxide film was dyed without any intervening treatment being performed, and the reference sign P3 indicates a region where the oxide film was dyed after the surface activation was performed. In the material strips of Examples 3–12, the region P3 was dyed as intended, while the region P2 was dyed rather faintly as compared to the region P3 and likely to suffer from the coming-off of the color. The material strips of Comparative Examples 1 and 2 were dyed poorly.

Examples 13–16

[Coloring]

Four AZ31 alloy plates (Supplier: Toyo Mark Co., Ltd., Size: 70 mm×20 mm×1.5 mm) were prepared for the material strips of Examples 13–16. As in Examples 3–12, the material strips of Examples 13–16 were subjected to the degreasing step, the first rinsing step, the anodizing step, and the second rinsing step. Then, the material strips were activated. In the activating step, the material strips were immersed in a surface activating solution containing 0.11M of potassium pyrophosphate (Supplier: Wako Pure Chemical Industries, Ltd.). Each material strip was immersed so that the region P3 shown in FIG. 5 was in the solution. The immersion time and the temperature of the surface activating solution were as follows. The material strip of Example 13 was immersed in the solution for 10 minutes, where the temperature of the solution was kept at 25° C. The material strip of Example 14 was immersed in the solution for 30 minutes, where the temperature of the solution was kept at 25° C. The material strip of Example 15 was immersed in the solution for 10 minutes, where the temperature of the solution was kept at 60° C. The material strip of Example 16 was immersed in the solution for 30 minutes, where the temperature of the solution was kept at 60° C.

Then, the activated material strips were rinsed with running water (the third rinsing step) and dried. Then, the material strips were dyed. Specifically, each of the material strips was immersed for ten minutes in a dye solution that contained 3 g/L of blue dye (Tradename: Sanodal Blue, Supplier: Clariant K. K.) and kept at 55° C. The pH level of the dye solution was adjusted to be 5.5 by addition of ammonium acetate buffer solution. Each material strip was immersed so that the regions P2 and P3 shown in FIG. 5 were in the dye solution. Then, the material strip was pulled out of the solution and rinsed with running water for at least 30 seconds. Thereafter, the material strip was subjected to nitrogen blow. Then, the material strip was left in an oven for 30 minutes to be dries at a temperature of 130° C.

[Results of Dyeing]

FIG. 5 schematically illustrates the state of the dye for the material strips of Examples 13–16. In each strip, the reference sign P1 indicates a bare metal region, the reference sign P2 indicates a region where the oxide film was dyed without any intervening treatment being performed, and the reference sign P3 indicates a region where the oxide film was dyed after the surface activation was performed. In the respective material strips, the region P3 was dyed as intended, while the region P2 was dyed rather faintly as compared to the region P3 and likely to suffer from the coming-off of the color.

EXAMPLES 17–26 AND COMPARATIVE EXAMPLES 3–12

[Coloring]

For Examples 17–26 and Comparative Examples 3–12, seventeen AZ31 alloy plates (Supplier: Toyo Mark, Size: 70 mm×20 mm×1.5 mm) were prepared as material strips. Similarly to Examples 3–12, these material strips were subjected to the degreasing step, the first rinsing step, the anodizing step, and the second rinsing step. Then, the material strips were activated. In the activation, the material strips of Examples 17–21 were immersed in a surface activating solution containing a silane coupling agent (Tradename: KBM-903, Supplier: Sin-Etsu Chemical Co., Ltd.) having amino group. The material strips of Examples 22–26 were immersed in a surface activating solution containing another coupling agent (Tradename: A-1120, Supplier: Nippon Unicar Co., Ltd.). The material strips of Comparative Examples 3–7 were immersed in a surface activating solution containing a silane coupling agent (Tradename: KBM-803, Supplier: Sin-Etsu Chemical Co., Ltd.) having mercapto group. These coupling agents are alkaline agents in which the magnesium alloys do not dissolve. Each material strip as a whole was completely put in the solution for 10 seconds, where the solution was kept at 25° C. Then, the material strip was out of the solution for drying. The immersion in the solution and the subsequent drying were performed three times with respect to each material strip. The material strips of Comparative Examples 8–12 were not subjected to activation.

Then, the material strips of Examples 17–26 and Comparative Examples 3–12 were subjected to dyeing. Specifically, the material strips of Examples 17, 22 and Comparative Examples 3, 8 were immersed in a dye solution containing 5 g/L of azo dye (Tradename: Sanodal Orange, Supplier: Clariant K. K.). The material strips of Examples 18, 23 and Comparative Examples 4, 9 were immersed in a dye solution containing 3 g/L of anthraquinone dye (Tradename: Sanodal Blue, Supplier: Clariant K. K.). The material strips of Examples 19, 24 and Comparative Examples 5, 10 were immersed in a dye solution containing 3 g/L of methine dye (Tradename: Sanodal Yellow, Supplier: Clariant K. K.). The material strips of Examples 20, 25 and Comparative Examples 6, 11 were immersed in a dye solution containing 1 g/L of another azo dye (Tradename: Aluminum Green, Supplier: Clariant K. K.). The material strips of Examples 21, 26 and Comparative Examples 7, 12 were immersed in a dye solution containing 5 g/L of phthalocyanine dye (Tradename: Sanodal Turquoise, Supplier: Clariant K. K.). Each dyeing solution was adjusted to have a pH level of 5.5 by addition of ammonium acetate buffer solution and kept at 55° C. during the dyeing. Each material strip as a whole was completely put in the dyeing solution. Thereafter, each material strip was pulled out of the solution and rinsed with running water for at least 30 seconds. Then, the material strip was subjected to nitrogen blow and left in an oven for 30 minutes to be dried at a temperature of 130° C.

[Results of Dyeing]

FIG. 6 schematically illustrates the state of the dye for the material strips of Examples 17–26 and Comparative Examples 3–12. The material strips of Examples 17–21 (activated by the KBM-903 amino-silane coupling agent) and the material strips of Examples 22–26 (activated by the A-1120 coupling agent) were dyed as intended. However, the material strips of Comparative Examples 3–7 activated by the KBM-803 mercapto-silane coupling agent were not dyed because the film of the coupling agent repelled the dyeing solution. The material strips of Comparative Examples 8–12 were dyed rather faintly as compared to Examples 17–26, and likely to suffer from the coming-off of the color According to the first embodiment of the present invention, a magnesium material can be colored simultaneously with the formation of an anode oxide film. Therefore, it is possible to reduce the number of process steps in manufacturing a colored magnesium product.

Moreover, when the magnesium material is colored with an inorganic pigment but without utilizing a paint, the resulting anode oxide film is also inorganic. Therefore, even when the magnesium product made of the colored magnesium material is burned in a furnace for recycling, the generation of toxic gas can be avoided. According to the second embodiment of the present invention again, no toxic gas is generated in the recycling process since no paint is applied on a surface. Moreover, since the activated surface of a white oxide film is dyed, the desired color is reliably provided.

What is claimed is:

1. A method of coloring an object made of a magnesium material selected from the group consisting of pure metal magnesium and a magnesium alloy, the method comprising growing an anode oxide film on a surface of said object by subjecting said object to anodization, the anode oxide film being colored by a non-painting process;

wherein said anodization utilizes an electrolyte containing a particulate pigment, the color of the anode oxide film being provided by allowing the particulate pigment to be taken into the anode oxide film growing on said surface of said object.

2. The method according to claim 1, wherein the pigment comprises an inorganic pigment.

3. The method according to claim 1, wherein the pigment comprises a lake pigment provided by dyeing an extender pigment.

4. The method according to claim 1, wherein the electrolyte used in said anodization is selected from the group consisting of sodium aluminate, sodium metasilicate, and sodium silicate.

5. The method according to claim 1, further comprising the step of covering the colored anode oxide film with an inorganic coating material.

6. A method of coloring an object made of a magnesium material selected from the group consisting of pure metal magnesium and a magnesium alloy, the method comprising growing an anode oxide film on a surface of said object by subjecting said object to anodization, the anode oxide film being colored by a non-painting process, the method further comprising the steps of:

activating a surface of the anode oxide film; and dyeing the activated surface with a dye to provide the color of the anode oxide film;

wherein the surface of the anode oxide film is roughened in the activating step by exposure to one selected from the group consisting of a complexing agent and a pyrophosphate.

7. A method of coloring an object made of a magnesium material selected from the group consisting of pure metal magnesium and a magnesium alloy, the method comprising growing an anode oxide film on a surface of said object by subjecting said object to anodization, the anode oxide film being colored by a non-painting process, the method further comprising the steps of:

activating a surface of the anode oxide film; and dyeing the activated surface with a dye to provide the color of the anode oxide film;

wherein the surface of the anode oxide film is chemically modified in the activating step by exposure to a silane coupling agent having an amino group.

8. A housing made of a magnesium material for a portable device, the housing being colored by a method according to any one of claim 1, 2, 3, 4, or 5.

* * * * *